US011209741B2

(12) United States Patent
Lu et al.

(10) Patent No.: US 11,209,741 B2
(45) Date of Patent: Dec. 28, 2021

(54) FLUORESCENT GREEN TONERS WITH ENHANCED BRIGHTNESS

(71) Applicant: Xerox Corporation, Norwalk, CT (US)

(72) Inventors: Chunliang Lu, Webster, NY (US); Yu Qi, Penfield, NY (US); Peter V. Nguyen, Webster, NY (US); Eliud Robles-Flores, Rochester, NY (US); Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 5 days.

(21) Appl. No.: 16/822,531

(22) Filed: Mar. 18, 2020

(65) Prior Publication Data

US 2021/0294233 A1 Sep. 23, 2021

(51) Int. Cl.

| | |
|---|---|
| ***G03G 9/093*** | (2006.01) |
| ***G03G 9/09*** | (2006.01) |
| ***G03G 9/08*** | (2006.01) |

(52) U.S. Cl.

CPC ..... *G03G 9/0926* (2013.01); *G03G 9/0804* (2013.01); *G03G 9/0918* (2013.01); *G03G 9/09357* (2013.01); *G03G 9/09371* (2013.01); *G03G 9/09378* (2013.01)

(58) Field of Classification Search

CPC ..... G03G 9/0926; G03G 9/0918

See application file for complete search history.

(56) References Cited

U.S. PATENT DOCUMENTS

| | | | |
|---|---|---|---|
| 5,604,076 | A | 2/1997 | Patel et al. |
| 6,413,692 | B1 | 7/2002 | Cheng |
| 6,455,220 | B1 | 9/2002 | Cheng |
| 8,541,154 | B2 | 9/2013 | Iftime et al. |
| 8,810,630 | B2 | 8/2014 | Kim et al. |
| 8,916,317 | B2 | 12/2014 | Iftime et al. |

(Continued)

FOREIGN PATENT DOCUMENTS

| | | | | |
|---|---|---|---|---|
| CA | 2469269 | A1 * | 8/2003 | ..... C09B 57/004 |
| EP | 1521128 | A2 | 4/2005 | |

(Continued)

OTHER PUBLICATIONS

English language machine translation of JP 59-197046 . (Year: 1984).*

(Continued)

*Primary Examiner* — Peter L Vajda

(74) *Attorney, Agent, or Firm* — Bell & Manning, LLC; N. Meredith Porembski

(57) ABSTRACT

Fluorescent green toners are provided. In embodiments, a fluorescent green toner comprises fluorescent agent-incorporated resin particles comprising a resin, a fluorescence brightener, and a yellow fluorescent agent having an absorption spectrum that overlaps with a fluorescence emission spectrum of the fluorescence brightener; and a cyan colorant; blue dye-incorporated resin particles comprising the resin and a blue dye; or both. The fluorescent green toner has a weight ratio of the yellow fluorescent agent to the cyan colorant and, if present, the blue dye, in a range of from 100:1 to 0.2:1, and the fluorescent green toner exhibits Förster Resonance Energy Transfer (FRET) under illumination with UV light. Methods of making and using the fluorescent green toners are also provided.

20 Claims, 1 Drawing Sheet

(56) References Cited

U.S. PATENT DOCUMENTS

| | | | |
|---|---|---|---|
| 9,280,076 | B1 | 3/2016 | Li et al. |
| 9,557,670 | B2 | 1/2017 | Shiba et al. |
| 10,254,667 | B2 | 4/2019 | Tanaka et al. |
| 2008/0090726 | A1 | 4/2008 | Eskra et al. |
| 2009/0047593 | A1 | 2/2009 | Vanbesien et al. |
| 2010/0135700 | A1 | 6/2010 | Mutoh et al. |
| 2010/0173239 | A1 | 7/2010 | Iftime et al. |
| 2010/0248118 | A1 | 9/2010 | Gong et al. |
| 2011/0223528 | A1 | 9/2011 | Ohno et al. |
| 2012/0021353 | A1 | 1/2012 | Nagasawa et al. |
| 2012/0043504 | A1 | 2/2012 | Yang et al. |
| 2012/0237868 | A1 | 9/2012 | Yamada et al. |
| 2014/0197364 | A1 | 7/2014 | Richards-Johnson et al. |
| 2014/0370438 | A1 | 12/2014 | Qui et al. |
| 2017/0145236 | A1* | 5/2017 | Harada ..... G03G 9/0918 |
| 2018/0157184 | A1 | 6/2018 | Jan |
| 2018/0258237 | A1 | 9/2018 | Smink et al. |
| 2020/0002555 | A1 | 1/2020 | Abril |
| 2020/0073271 | A1 | 3/2020 | Satoru |
| 2021/0141318 | A1 | 5/2021 | Flores et al. |

FOREIGN PATENT DOCUMENTS

| | | | | |
|---|---|---|---|---|
| EP | 2290454 | A1 | 3/2011 | |
| EP | 3457214 | A1 | 8/2018 | |
| GB | 1422526 | A * | 1/1976 | ..... C09K 11/06 |
| JP | 59197046 | A * | 11/1984 | ..... G03G 9/09 |
| JP | 1-101558 | | 10/1987 | |
| JP | H01 201677 | | 8/1989 | |
| JP | 200244336 | | 8/2002 | |
| JP | 2005-208362 | | 8/2005 | |
| JP | 2009-086331 | A | 4/2009 | |
| WO | WO2011/013697 | A1 | 2/2011 | |
| WO | WO 2018/190247 | A1 | 10/2018 | |

OTHER PUBLICATIONS

Extended Search Report issued on EP Application 21160843.5, dated Aug. 16, 2021.

* cited by examiner

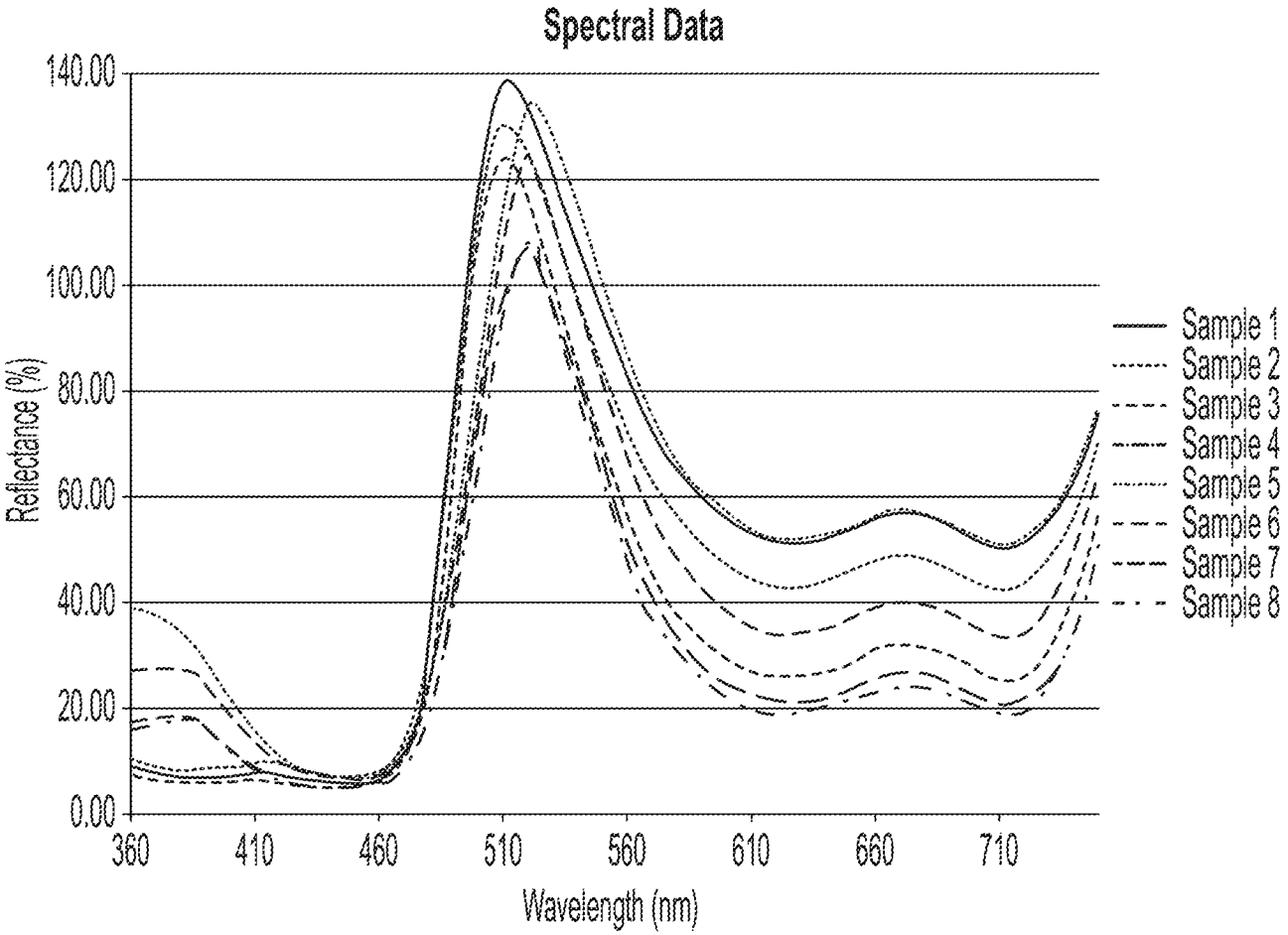
Spectral Data
Sample 1
Sample 2
Sample 3
Sample 4
Sample 5
Sample 6
Sample 7
Sample 8
Reflectance (%)
140.00
120.00
100.00
80.00
60.00
40.00
20.00
0.00
360
410
460
510
560
610
660
710
Wavelength (nm)

FLUORESCENT GREEN TONERS WITH ENHANCED BRIGHTNESS

BACKGROUND

Conventional xerographic printing systems for toner applications consist of four stations comprising cyan, magenta, yellow, and black (CMYK) toner stations. These and other xerographic printing systems can be made to print specialty colors, including fluorescent toners. A variety of fluorescent toners have been developed, but improved fluorescent toners are desirable.

SUMMARY

The present disclosure provides fluorescent green toners. Related methods are also provided.

In one aspect, fluorescent green toners are provided. In embodiments, a fluorescent green toner comprises fluorescent agent-incorporated resin particles comprising a resin, a fluorescence brightener, and a yellow fluorescent agent having an absorption spectrum that overlaps with a fluorescence emission spectrum of the fluorescence brightener; and a cyan colorant; blue dye-incorporated resin particles comprising the resin and a blue dye; or both. The fluorescent green toner has a weight ratio of the yellow fluorescent agent to the cyan colorant and, if present, the blue dye, in a range of from 100:1 to 0.2:1, and the fluorescent green toner exhibits Förster Resonance Energy Transfer (FRET) under illumination with UV light.

In another aspect, methods of making fluorescent green toners are provided. In embodiments, such a method comprises forming one or more fluorescent latexes which comprise a fluorescence brightener, a yellow fluorescent agent having an absorption spectrum that overlaps with a fluorescence emission spectrum of the fluorescence brightener, a first type of amorphous resin, and a second type of amorphous resin; forming a cyan dispersion comprising a cyan colorant and a surfactant; forming a mixture comprising the one or more fluorescent latexes; the cyan dispersion; one or more emulsions which comprise a crystalline resin, the first type of amorphous resin, the second type of amorphous resin; and optionally, a wax dispersion; aggregating the mixture to form particles of a predetermined size; forming a shell over the particles of the predetermined size to form core-shell particles; and coalescing the core-shell particles to form a fluorescent green toner. The fluorescent green toner has a weight ratio of the yellow fluorescent agent to the cyan colorant in a range of from 100:1 to 0.2:1 and the fluorescent green toner exhibits FRET under illumination with UV light.

BRIEF DESCRIPTION OF THE DRAWINGS

Illustrative embodiments of the disclosure will hereafter be described with reference to the accompanying drawings.

FIG. 1 shows reflectance spectra of fluorescent green toners according to an illustrative embodiment. The toner mass area (TMA) was 0.5 mg/cm$^2$.

DETAILED DESCRIPTION

The present disclosure provides fluorescent green toners, methods of making the toners, and methods of using the toners.

The fluorescent green toners comprise fluorescent agent-incorporated resin particles and a cyan colorant and/or blue dye-incorporated resin particles. The fluorescent agent-incorporated resin particles are resin particles having incorporated therein a yellow fluorescent agent. Optionally, but preferably, a fluorescent brightener is also incorporated therein. The yellow fluorescent agent and the fluorescent brightener (if present) are selected such that they form a pair capable of undergoing Förster resonance energy transfer (FRET). As such, the pair may be referred to as a FRET pair. The fluorescent green toner particles may be in the form of a core comprising the fluorescent agent-incorporated resin particles and cyan colorant and/or blue dye-incorporated resin particles, and a shell over the core, the shell also comprising one or more resins which may or may not be the same as the resin(s) within the core. The resin of the fluorescent agent-incorporated resin particles and the blue dye-incorporated resin particles may be the same or different.

Although some fluorescent toners have been developed, it is particularly challenging to incorporate fluorescent agents into a toner along with colorants without negatively affecting the optical properties of the fluorescent agents. For example, the fluorescence of the fluorescent agents is easily quenched within the toner, resulting in the toner have little to no fluorescence. The present disclosure is based, at least in part, on the development of an improved toner preparation process that prevents such quenching and results in green toners which emit fluorescence under ultraviolet (UV) light (which may be provided by sunlight) and which have high lightness L* values. In addition, due to the FRET pair as noted above, overall fluorescence emission from the fluorescent green toner is increased, thereby boosting the brightness and color intensity, of the fluorescent green toner.

Fluorescent Agent

As noted above, fluorescent green toners are provided which comprise a fluorescent brightener and a yellow fluorescent agent selected such that they form a FRET pair. The fluorescent brightener and the yellow fluorescent agent are each characterized by an absorption spectrum and an emission spectrum. In order to form a FRET pair, the emission spectrum of the fluorescent brightener must adequately overlap with the absorption spectrum of the yellow fluorescent agent. Upon illumination with light (e.g., ultraviolet (UV) light) to excite the fluorescent brightener, the excited fluorescent brightener transfers energy to the yellow fluorescent agent via nonradiative energy transfer to induce fluorescence emission from the yellow fluorescent agent. The UV light may be provided by sunlight which includes UV light. The degree of overlap between the normalized emission spectrum of the fluorescent brightener and the normalized absorption spectrum of the yellow fluorescent agent need not be complete. Partial overlap may still allow for FRET between the pair. Nevertheless, the greater degree of overlap, the greater the FRET efficiency and the greater the overall fluorescence emission from the fluorescent green toner. In embodiments, the degree of overlap is greater than 5%, greater than 15%, greater than 20%, greater than 30%, or in a range of from 30% to 100%.

In embodiments, the fluorescent brightener has an absorption spectrum spanning a range of from 300 nm to 400 nm and an emission spectrum spanning a range of from 380 nm to 650 nm. This includes the fluorescent brightener having an absorption spectrum spanning a range of from 300 nm to 380 nm. This includes the fluorescent brightener having an emission spectrum spanning a range of from 400 nm to 550 nm. It is also desirable that the fluorescent brightener absorb no light in a range of from 380 nm to 700 nm. The phrase "no light" encompasses zero but also a small amount of absorption, provided the fluorescent brightener appears colorless to the human eye. As noted above, the yellow fluorescent agent has an absorption spectrum that overlaps with the emission spectrum of the fluorescent brightener. In embodiments, the yellow fluorescent agent has an absorption spectrum spanning a range of from 370 nm to 520 nm.

FRET efficiency is also related to the separation distance (d) between donor (fluorescent brightener) and acceptor (fluorescent dye) molecules (efficiency$\propto d^{-6}$). Thus, to actually achieve FRET in the present fluorescent green toners, the fluorescent brightener and the fluorescent dye molecule are sufficiently close together (i.e., present at sufficiently high concentration, although not so high as to result in fluorescence quenching) and homogeneously distributed in the resin particles. Homogeneous distribution and encapsulation of the fluorescent brightener and the yellow fluorescent agent within the particles of the toner is also useful to prevent fluorescence quenching when fluorescent agents are combined with other components such as in toner particles. Encapsulation refers to having none of the relevant component (e.g., fluorescent agent) at or on the surface of the particles of the toner. Below, a toner preparation process that achieves a homogeneous distribution of fluorescent agents and encapsulation to prevent quenching and facilitate FRET is described in greater detail. Confirmation of fluorescence emission and FRET may be carried out as further described below.

Illustrative fluorescent brighteners include the following: Fluorescent Brightener 184, Optical Brightener 1 (Fluorescent Brightening Agent 393), Optical Brightener 2, Optical Brightener 3, Optical Brightener C, Optical Brightener OB, Optical Brightener R, Optical Brightener Hostalux KSN, Optical Brightener Hostalux KCB, Optical Brightener Telalux KSB, Fluorescent Brightener 127, CBS-127, Optical Brightener PF, Optical Brightener UVT1, Optical Brightener ST, Optical Brightener OEF, Optical Brightener RT, Tinopal CBS-X, DMS/AMS, CBS-155, 378, 367, 368, 185, 199, 199:1, 199:2, Optical Brightener ER-IV, Optical Brightener ER-V, Optical Brightener 4BK, Optical Brightener ER-I/ER-I L, Optical Brightener ER-II/ER-II L, Optical Brightener EBF/EBF-L, PF/DT, BA, CXT, R4, MST-L, BAC, SWN/AW-L, WGS, NFW, PC, BBU/BBU-L, VBL/VBL-L. In embodiments, the fluorescent brightener is Fluorescent Brightener 184. Combinations of different types of fluorescent brighteners may be used.

Illustrative yellow fluorescent agents include the following: Solvent Yellow 160:1, Solvent Yellow 98, Solvent Yellow 43, Basic Yellow 40. In embodiments, the fluorescent dye is Solvent Yellow 160:1, Solvent Yellow 98, or combinations thereof.

Combinations of different types of fluorescent brighteners and different types of yellow fluorescent agents may be used such that the fluorescent green toner comprises more than one FRET pair.

The total amount of the fluorescent agents (fluorescent brightener(s) and yellow fluorescent agent(s)) may be present in the fluorescent green toner in an amount of, for example, from 0.1 weight % to 10 weight % by weight of the fluorescent green toner. This includes a total amount of from 0.1 weight % to 8 weight %, from 0.2 weight % to 6 weight %, from 0.5 weight % to 5 weight %, and from 1 weight % to 2 weight %. These ranges are useful to achieve an appropriate concentration to ensure FRET while also preventing fluorescence quenching. The relative amount of the fluorescent brightener and the yellow fluorescent agent in the fluorescent green toner may vary. In embodiments, the weight ratio of the fluorescent brightener:yellow fluorescent agent is in a range of from 1:200 to 1:0.01, from 1:50 to 1:0.05, or from 1:10 to 1:0.5.

Cyan Colorant/Blue Dye

The present toners comprise either a cyan colorant, a blue dye, or both. Cyan colorants include Pigment Blue 15:3, Pigment Blue 15:1, Pigment Blue 15:2, Pigment Blue 15:4, and Pigment Blue 15:6. Blue dyes include Solvent Blue 67, Solvent Blue 104, etc. Different types of cyan colorants, blue dyes or combinations thereof may be used. However, in embodiments, only Pigment Blue 15:3 is used. The cyan colorant is generally encapsulated within the particles of the toner such that no cyan colorant is present at or on the surface of the particles. Encapsulation may be confirmed using scanning and transmission electron microscopy (SEM/TEM). The cyan colorant is generally homogenously distributed throughout the resin matrix of the particles of the toner. The distribution may also be confirmed using SEM/TEM. The blue dye may be homogeneously distributed and encapsulated as described above with respect to the fluorescent agents.

The relative amount of the yellow fluorescent agent and the cyan colorant is selected to achieve a color channel a* of from −50 to −90 and a color channel b* of from 60 to 100. (Color channels are further described below.) This includes a color channel a* of from −60 to −80 and a color channel b* of from 60 to 80. These relative amounts correspond to a weight ratio of yellow:cyan/blue in a range of from 100:1 to 0.2:1. This includes from 70:1 to 1:1, from 50:1 to 10:1, from 10:1 to 1:1 and from 5:1 to 1:1.

Resins

The present toners may comprise a variety of resins, which provides a polymeric matrix to contain both the cyan colorant/blue dye and the fluorescent agents described above. The present toners may comprise more than one different type of resin. The resin may be an amorphous resin, a crystalline resin, or a mixture of crystalline and amorphous resins. The resin may be a polyester resin, including an amorphous polyester resin, a crystalline polyester resin, or a mixture of crystalline polyester and amorphous polyester resins.

Crystalline Resin

The resin may be a crystalline polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, combinations thereof, and the like including their structural isomers. The aliphatic diol may be, for example, selected in an amount of from about 40 to about 60 mole percent of the resin, from about 42 to about 55 mole percent of the resin, or from about 45 to about 53 mole percent of the resin, and a second diol may be selected in an amount of from about 0 to about 10 mole percent of the resin or from about 1 to about 4 mole percent of the resin.

Examples of organic diacids or diesters including vinyl diacids or vinyl diesters selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, from about 40 to about 60 mole percent of the resin, from about 42 to about 52 mole percent of the resin, or from about 45 to about 50 mole percent of the resin, and a second diacid can be selected in an amount of from about 0 to about 10 mole percent of the resin.

Polycondensation catalysts which may be utilized in forming crystalline (as well as amorphous) polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate), and mixtures thereof. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), poly(propylene-sebecamide), and mixtures thereof. Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), poly(butylene-succinimide), and mixtures thereof.

In embodiments, the crystalline polyester resin has the following formula (I)

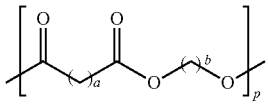

(I)

wherein each of a and b may range from 1 to 12, from 2 to 12, or from 4 to 12 and further wherein p may range from 10 to 100, from 20 to 80, or from 30 to 60. In embodiments, the crystalline polyester resin is poly(1,6-hexylene-1,12-dodecanoate), which may be generated by the reaction of dodecanedioc acid and 1,6-hexanediol.

As noted above, the disclosed crystalline polyester resins may be prepared by a polycondensation process by reacting suitable organic diols and suitable organic diacids in the presence of polycondensation catalysts. A stoichiometric equimolar ratio of organic diol and organic diacid may be utilized, however, in some instances where the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized may vary, and can be selected in amounts, such as for example, from about 0.01 to about 1 or from about 0.1 to about 0.75 mole percent of the crystalline polyester resin.

The crystalline resin may be present, for example, in an amount of from about 1 weight % to about 85 weight % by weight of the toner, from about 5 weight % to about 50 weight % by weight of the toner, or from about 10 weight % to about 35 weight % by weight of the toner.

The crystalline resin can possess various melting points of, for example, from about 30° C. to about 120° C., from about 50° C. to about 90° C., or from about 60° C. to about 80° C. The crystalline resin may have a number average molecular weight ($M_n$), as measured by gel permeation chromatography (GPC) of, for example, from about 1,000 to about 50,000, from about 2,000 to about 25,000, or from about 5,000 to about 20,000, and a weight average molecular weight ($M_w$) of, for example, from about 2,000 to about 100,000, from about 3,000 to about 80,000, or from about 10,000 to about 30,000, as determined by GPC. The molecular weight distribution ($M_w/M_n$) of the crystalline resin may be, for example, from about 2 to about 6, from about 3 to about 5, or from about 2 to about 4.

Amorphous Resin

The resin may be an amorphous polyester resin formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethyl succinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, from about 42 to about 52 mole percent of the resin, or from about 45 to about 50 mole percent of the resin.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected may vary, for example, the organic diols may be present in an amount from about 40 to about 60 mole percent of the resin, from about 42 to about 55 mole percent of the resin, or from about 45 to about 53 mole percent of the resin.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, and mixtures thereof.

An unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable polyester resin may be an amorphous polyester such as a poly(propoxylated bisphenol A co-fumarate) resin. Examples of such resins and processes for their production include those disclosed in U.S. Pat. No. 6,063,827, the disclosure of which is hereby incorporated by reference in its entirety.

Suitable polyester resins include amorphous acidic polyester resins. An amorphous acid polyester resin may be based on any combination of propoxylated bisphenol A, ethoxylated bisphenol A, terephthalic acid, fumaric acid, and dodecenyl succinic anhydride, such as poly(propoxylated bisphenol-co-terephthlate-fumarate-dodecenylsuccinate). Another amorphous acid polyester resin which may be used is poly(propoxylated-ethoxylated bisphenol-co-terephthalate-dodecenylsuccinate-trimellitic anhydride).

An example of a linear propoxylated bisphenol A fumarate resin which may be utilized as a resin is available under the trade name SPAMII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

An amorphous resin or combination of amorphous resins may be present, for example, in an amount of from about 5 weight % to about 95 weight % by weight of the toner, from about 30 weight % to about 90 weight % by weight of the toner, or from about 35 weight % to about 85 weight % by weight of the toner.

The amorphous resin or combination of amorphous resins may have a glass transition temperature of from about 30° C. to about 80° C., from about 35° C. to about 70° C., or from about 40° C. to about 65° C. The glass transition temperature may be measured using differential scanning calorimetry (DSC). The amorphous resin may have a $M_n$, as measured by GPC of, for example, from about 1,000 to about 50,000, from about 2,000 to about 25,000, or from about 1,000 to about 10,000, and a $M_w$ of, for example, from about 2,000 to about 100,000, from about 5,000 to about 90,000, from about 10,000 to about 90,000, from about 10,000 to about 30,000, or from about 70,000 to about 100,000, as determined by GPC.

One, two, or more resins may be used in the present toners. Where two or more resins are used, the resins may be in any suitable ratio (e.g., weight ratio) such as for instance of from about 1% (first resin)/99% (second resin) to about 99% (first resin)/1% (second resin), from about 10% (first resin)/90% (second resin) to about 90% (first resin)/10% (second resin). Where the resins include a combination of amorphous and crystalline resins, the resins may be in a weight ratio of, for example, from about 1% (crystalline resin)/99% (amorphous resin) to about 99% (crystalline resin)/1% (amorphous resin), or from about 10% (crystalline resin)/90% (amorphous resin) to about 90% (crystalline resin)/10% (amorphous resin). In some embodiments, the weight ratio of the resins is from about 80 weight % to about 60 weight % of the amorphous resin and from about 20 weight % to about 40 weight % of the crystalline resin. In such embodiments, the amorphous resin may be a combination of amorphous resins, e.g., a combination of two amorphous resins.

The resin(s) in the present toners may possess acid groups which may be present at the terminal of the resin. Acid groups which may be present include carboxylic acid groups, and the like. The number of carboxylic acid groups may be controlled by adjusting the materials utilized to form the resin and reaction conditions. In embodiments, the resin is a polyester resin having an acid number from about 2 mg KOH/g of resin to about 200 mg KOH/g of resin, from about 5 mg KOH/g of resin to about 50 mg KOH/g of resin, or from about 5 mg KOH/g of resin to about 15 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Wax

Optionally, a wax may be included in the present toners. A single type of wax or a mixture of two or more different waxes may be used. A single wax may be added, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight % to about 25 weight % by weight of the toner or from about 5 weight % to about 20 weight % by weight of the toner particles.

When a wax is used, the wax may include any of the various waxes conventionally used in emulsion aggregation toners. Waxes that may be selected include waxes having, for example, an average molecular weight of from about 500 to about 20,000 or from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polymethylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

Toner Preparation Process

In order to form the present fluorescent green toners, any of the resins described above may be provided as an emulsion(s), e.g., by using a solvent-based phase inversion emulsification process. The emulsions may then be utilized as the raw materials to form the toners, e.g., by using an emulsion aggregation and coalescence (EA) process.

In order to achieve encapsulation and a homogeneous distribution of the cyan colorant, a separate dispersion comprising the cyan colorant and a surfactant are generally used in the toner preparation process. Illustrative surfactants include anionic surfactants such as diphenyl oxide disulfonate, ammonium lauryl sulfate, sodium dodecyl benzene sulfonate, dodecyl benzene sulfonic acid, sodium alkyl naphthalene sulfonate, sodium dialkyl sulfosuccinate, sodium alkyl diphenyl ether disulfonate, potassium salt of alkylphosphate, sodium polyoxyethylene lauryl ether sulfate, sodium polyoxyethylene alkyl ether sulfate, sodium polyoxyethylene alkyl ether sulfate, triethanolamine polyoxyethylene alkylether sulfate, sodium naphthalene sulfate, and sodium naphthalene sulfonate formaldehyde condensate, and mixtures thereof; and nonionic surfactants such as polyvinyl alcohol, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene nonylphenyl ether, polyoxyethylene oleyl ether, polyoxyethylene sorbitan monolaurate, polyoxyethylene stearyl ether, dialkylphenoxy poly(ethyleneoxy)ethanol, and mixtures thereof. However, in embodiments, the surfactant is dodecyl benzene sulfonic acid and this surfactant is present in the separate dispersion at an amount in a range of from 1.5 weight % to 4 weight % by weight as compared to the amount of the cyan colorant. This surfactant and these amounts are useful to achieved encapsulation and homogeneous distribution of the cyan colorant in the toner particles. The cyan colorant, once incorporated into the toner particles using this surfactant and these amounts, may be referred to as "cyan colorant-incorporated resin." As noted above, encapsulation and homogeneous distribution may be confirmed using SEM/TEM.

As noted above, in order to achieve similar encapsulation and homogeneous distribution of the fluorescent agents as well as to prevent fluorescence quenching and facilitate FRET, a separate latex (a fluorescent latex) comprising the desired fluorescent agent and the desired resin is generally used in the preparation process. The desired fluorescent agent may include both the fluorescent brightener and the yellow fluorescent agent. The desired resin may include more than one type of resin. It is desirable for FRET pairs to be formed in the same fluorescent latex in order to facilitate FRET. However, as also noted above, separate fluorescent latexes may be prepared and used to form the present fluorescent green toners, e.g., one fluorescent latex comprising the fluorescent brightener and another fluorescent latex comprising the yellow fluorescent agent.

As noted above, each fluorescent latex may comprise a single type of resin, e.g., a single type of amorphous polyester resin, or multiple types of resins, e.g., two different types of amorphous polyester resins. In such embodiments, one of the amorphous polyester resins has an $M_n$ or $M_w$ that is greater than the other. In embodiments in which two different types of amorphous polyester resins are used, the weight ratio of the two types may be from 2:3 to 3:2. This includes a weight ratio of 1:1. Alternatively, two separate fluorescent latexes may be used, each comprising a different type of amorphous polyester resin. However, together, the fluorescent latex(es) provide the two different types of amorphous polyester resins within this range of weight ratios. These weight ratios are useful for ensuring a homogeneous distribution of the fluorescent agents once incorporated into the resin particles. This also prevents fluorescence quenching while facilitating FRET.

The fluorescent agent/resins, once incorporated into the toner particles using the process and fluorescent agent amounts described above, may be referred to as "fluorescent agent-incorporated resins".

If a blue dye is used, it may be incorporated into the toner as a separate latex as described above with respect to the fluorescent latexes.

If a resin is incorporated into the toner particles using an emulsion free of a fluorescent agent/colorant/dye, that resin may be referred to as a resin not incorporated with the fluorescent agent/colorant/dye, or simply as the "resin," i.e., not modified with the phrase "fluorescent agent-incorporated/colorant-incorporated/dye-incorporated."

If a wax is used, it may be incorporated into the toner as a separate dispersion of the wax in water.

In embodiments, the present fluorescent green toners are prepared by EA processes, such as by a process that includes aggregating a mixture of an emulsion comprising a resin; the cyan colorant or the blue dye or both; the fluorescent brightener; the yellow fluorescent agent; and optionally, a wax; and then coalescing the mixture. As described above, the cyan colorant is generally provided to the mixture as a separate dispersion and the blue dye is generally provided to the mixture as a separate latex. Similarly, the fluorescent brightener/yellow fluorescent agent is generally provided to the mixture as one or more separate fluorescent latexes as described above (but preferably, one to ensure FRET). The emulsion comprising the resin may comprise one or more resins or different resins may be provided as different emulsions. The emulsion(s) comprising the resin generally do not comprise and thus, are free of the fluorescent agents/colorant/dye.

Next, the mixture may be homogenized which may be accomplished by mixing at about 600 to about 6,000 revolutions per minute. Homogenization may be accomplished by any suitable means, including, for example, an IKA ULTRA TURRAX T50 probe homogenizer. An aggregating agent may be added to the mixture. Any suitable aggregating agent may be utilized. Suitable aggregating agents include, for example, aqueous solutions of a divalent cation or a multivalent cation material. The aggregating agent may be, for example, an inorganic cationic aggregating agent such as a polyaluminum halide such as polyaluminum chloride (PAC), or the corresponding bromide, fluoride, or iodide; a polyaluminum silicate such as polyaluminum sulfosilicate (PASS); or a water soluble metal salt including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, and copper sulfate; or combinations thereof. The aggregating agent may be added to the mixture at a temperature that is below the glass transition temperature ($T_g$) of the resin (s). The aggregating agent may be added to the mixture under homogenization.

The aggregating agent may be added to the mixture in an amount of, for example, from about 0 weight % to about 10 weight % by weight of the total amount of resin, from about 0.2 weight % to about 8 weight % by weight of the total amount of resin, or from about 0.5 weight % to about 5 weight % by weight of the total amount of resin.

The particles of the mixture may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for volume average particle size. The aggregation thus may proceed by maintaining an elevated temperature, or slowly raising the temperature to, for example, in embodiments, from about 30° C. to about 100° C., in embodiments from about 30° C. to about 80° C., or in embodiments from about 30° C. to about 50° C. The temperature may be held for a period time of from about 0.5 hours to about 6 hours, or in embodiments from about hour 1 to about 5 hours, while stirring, to provide the aggregated particles. Once the predetermined desired particle size is reached, a shell may be added. The volume average particle size of the particles prior to application of a shell may be, for example, from about 3 μm to about 10 μm, in embodiments, from about 4 μm to about 9 μm, or from about 6 μm to about 8 μm.

Shell Resin

After aggregation, but prior to coalescence, a resin coating may be applied to the aggregated particles to form a shell thereover. Any of the resins described above may be utilized in the shell. In embodiments, an amorphous polyester resin is utilized in the shell. In embodiments, two amorphous polyester resins are utilized in the shell. In embodiments, a crystalline polyester resin and two different types of amorphous polyester resins are utilized in the core and the same two types of amorphous polyester resins are utilized in the shell. The shell resins generally do not comprise, and thus, are free of, fluorescent agent.

The shell may be applied to the aggregated particles by using the shell resins in the form of emulsion(s) as described above. Such emulsions may be combined with the aggregated particles under conditions sufficient to form a coating over the aggregated particles. For example, the formation of the shell over the aggregated particles may occur while heating to a temperature of from about 30° C. to about 80° C. or from about 35° C. to about 70° C. The formation of the shell may take place for a period of time from about 5 minutes to about 10 hours or from about 10 minutes to about 5 hours.

Once the desired size of the toner particles is achieved, the pH of the mixture may be adjusted with a pH control agent, e.g., a base, to a value of from about 3 to about 10, or in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, a chelating agent such as ethylene diamine tetraacetic acid (EDTA) may be added to help adjust the pH to the desired values noted above. Other chelating agents may be used.

In embodiments, the size of the core-shell toner particles (prior to coalescence) may be from about 3 μm to about 10 μm, from about 4 μm to about 10 μm, or from about 6 μm to about 9 μm.

Coalescence

Following aggregation to the desired particle size and application of the shell, the particles may then be coalesced to the desired final shape, the coalescence being achieved by, for example, heating the mixture to a temperature of from about 45° C. to about 150° C., from about 55° C. to about 99° C., or about 60° C. to about 90° C., which may be at or above the glass transition temperature of the resins utilized to form the toner particles. Heating may continue or the pH of the mixture may be adjusted (e.g., reduced) over a period of time to reach the desired circularity. The period of time may be from about 1 hours to about 5 hours or from about 2 hours to about 4 hours. Various buffers may be used during coalescence. The total time period for coalescence may be from about 1 to about 9 hours, from about 1 to about 8 hours, or from about 1 to about 5 hours. Stirring may be utilized during coalescence, for example, from about 20 rpm to about 1000 rpm or from about 30 rpm to about 800 rpm.

After aggregation and/or coalescence, the mixture may be cooled to room temperature. The cooling may be rapid or slow, as desired. A suitable cooling process may include introducing cold water to a jacket around the reactor. After cooling, the toner particles may be screened with a sieve of a desired size, filtered, washed with water, and then dried.

Drying may be accomplished by any suitable process for drying including, for example, freeze-drying.

Other Additives

In embodiments, the present fluorescent green toners may also contain other optional additives. For example, the toners may include positive or negative charge control agents. Surface additives may also be used. Examples of surface additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids such as zinc stearate, calcium stearate, and magnesium stearate, mixtures thereof and the like; long chain alcohols such as UNILIN 700; and mixtures thereof. Each of these surface additives may be present in an amount of from about 0.1 weight % to about 5 weight % by weight of the toner or from about 0.25 weight % by weight to about 3 weight % by weight of the toner.

Toner Properties

The fluorescence of the fluorescent green toners as well as the existence of FRET occurring in the fluorescent green toners may be confirmed and quantified using a spectrodensitometer (such as Hunter, X-Rite, etc.) or a fluorescence spectrometer, operated in accordance with the manufacturer's instructions. These systems may be used to determine lightness L*, color channels, a* and b*, and reflectance for the fluorescent green toners. Regarding lightness L*, the CIELAB color space (also known as CIE L*a*b* or sometimes abbreviated as simply "Lab" color space) is a color space defined by the International Commission on Illumination (CIE). It expresses color as three values: L* for the lightness from black (0) to white (100), a* from green (−) to red (+), and b* from blue (−) to yellow (+).

Because three parameters are measured, the space itself is a three-dimensional real number space, which allows for infinitely many possible colors. In practice, the space is usually mapped onto a three-dimensional integer space for digital representation, and thus the L*, a*, and b* values are usually absolute, with a pre-defined range. The lightness value, L*, represents the darkest black at L*=0, and the brightest white at L*=100. The color channels, a* and b*, represent true neutral gray values at a*=0 and b*=0. The a* axis represents the green-red component, with green in the negative direction and red in the positive direction. The b* axis represents the blue-yellow component, with blue in the negative direction and yellow in the positive direction. The scaling and limits of the a* and b* axes will depend on the specific implementation, but they often run in the range of ±100 or −128 to +127 (signed 8-bit integer).

As noted above, the present fluorescent green toners are characterized by a color channel a* and b* within the ranges described above. They are also characterized by a lightness L* of at least 75, at least 80, at least 85, or at least 90. In addition, the fluorescent green toners having at least one FRET pair of the fluorescent brightener and the yellow fluorescent agent and exhibiting FRET (due to appropriate concentration and homogeneous distribution) are characterized as having significantly higher reflectance values as compared to a comparative fluorescent green latex having the same composition but no fluorescent brightener. This is demonstrated in the Example, below.

Developers and Carriers

The present fluorescent green toners may be formulated into a developer composition. Developer compositions can be prepared by mixing the toners of the present disclosure with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The toners may be present in the carrier in amounts of from about 1 weight % to about 15 weight % by weight, from about 2 weight % to about 8 weight % by weight, or from about 4 weight % to about 6 weight % by weight. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Applications

The present fluorescent green toners may be used in a variety of xerographic processes and with a variety of xerographic printers. A xerographic imaging process includes, for example, preparing an image with a xerographic printer comprising a charging component, an imaging component, a photoconductive component, a developing component, a transfer component, and a fusing component. In embodiments, the development component may include a developer prepared by mixing a carrier with any of the toners described herein. The xerographic printer may be a high-speed printer, a black and white high-speed printer, a color printer, and the like. Once the image is formed with the toners/developers, the image may then be transferred to an image receiving medium such as paper and the like. Fuser roll members may be used to fuse the toner to the image-receiving medium by using heat and pressure.

EXAMPLE

The following Example is being submitted to illustrate various embodiments of the present disclosure. The Example is intended to be illustrative only and is not intended to limit the scope of the present disclosure. Also, parts and percentages are by weight unless otherwise indicated. As used throughout this patent specification, "room temperature" refers to a temperature of from 20° C. to 25° C.

Fluorescent latexes were prepared as follows. A mixture of 120 g of a first type of an amorphous polyester resin, 80 g of a second type of an amorphous polyester resin, a fluorescent brightener, and a yellow fluorescent agent were dissolved in a mixture of acetone, ethyl acetate and aqueous ammonia solution with a ratio of (145/48/40 g) in a 2 L reactor at 40° C. Additional base solution was added to each mixture to completely neutralize the polyester resins. After about one hour and complete homogenization, deionized water was added to each mixture. The organic solvents were removed by applying a vacuum and water was added during this process to maintain the amount of desired water (to achieve a desired solids %). Finally, the resulting emulsion was filtered through a 25 μm sieve. Emulsions had a particle size of from 50-500 nm, and a solids content of about 35%. Fluorescent latexes having total fluorescent agent content of from about 2 weight % to about 7 weight % as compared to the total weight of the fluorescent latex were prepared. About 2 weight % surfactant (Calfax) was added to stabilize the fluorescent latex.

Comparative fluorescent latexes were formed as described above but without using a fluorescent brightener.

A cyan dispersion was prepared which included deionized water, Pigment Blue 15:3 at 15 weight %, and a surfactant (dodecylbenzenesulfonic acid sodium salt at 2 weight % as compared to PB15:3 weight). The cyan dispersion had a particle size of from 50-500 nm, and a solids content of about 17%.

To form the fluorescent green toners, mixtures were formed by combining the following: the fluorescent latex; the cyan dispersion; a first emulsion comprising a crystalline polyester resin; a second emulsion comprising the first type of amorphous polyester resin; and a third emulsion comprising the second type of amorphous polyester resin. As shown in Table 1, various relative amounts of the fluorescent latex and the cyan dispersion were used. Aluminum sulfate (ALS) solution was added slowly while homogenizing each mixture. Each highly viscous mixture was transferred to a 2 L reactor and aggregation initiated by increasing the temperature to about 40-48° C. When the particle size (D50v) reached about 7.5 μm, an emulsion containing the two amorphous polyester resins was added to the mixture to form a shell over the particles and the particles were allowed to continue grow. The particles were frozen by adding a chelating agent and base. The reactor temperature was increased to about 84° C. for coalescence. The heating was stopped when the particles reached the desired circularity. The particle slurry was quenched, the particle dispersion was collected and then stirred overnight. The particles were then sieved, washed and dried.

Color analysis and reflectance spectra was conducted for the fluorescent green toners printed on papers using Gretag X-rite type instrument and operated according to the manufacturer's instructions. The results of the color analysis are shown in Table 1 and FIG. 1 shows reflectance spectra. Table 1 shows that each of the samples has an a*, b* values that falls within the green color space. FIG. 1 confirms the emission of green fluorescence from the toners. It also shows that the fluorescent green toners including the fluorescent brightener (Samples 1-4) have significantly increased peak reflectance (i.e., value of the reflectance at the peak) as compared to the corresponding comparative fluorescent green toner without the fluorescent brightener (Samples 5-8, respectively). The increased peak reflectance is believed to be due to FRET occurring between the fluorescence brightener and the yellow fluorescent agent. The results show that Samples 1-4 provide fluorescent green toners with enhanced brightness.

TABLE 1

Fluorescent Green Toners.

| Sample | Fluorescent Brightener in Fluorescent Latex (pph) | Yellow Fluorescent Agent in Fluorescent Latex (pph) | Yellow Fluorescent Agent weight in Toner (pph) | Cyan Pigment weight in Toner (pph) | L* | a* | b* |
|---|---|---|---|---|---|---|---|
| 1 | 0 | 1.8 | 1.2 | 0.31 | 93.48 | −59.46 | 78.83 |
| 2 | 0 | 1.8 | 1.2 | 0.53 | 86.49 | −69.04 | 70.13 |
| 3 | 0 | 1.8 | 1.2 | 0.66 | 78.93 | −75.70 | 65.61 |
| 4 | 0 | 1.8 | 1.2 | 0.78 | 77.80 | −78.58 | 62.02 |
| 5 | 1.8 | 1.8 | 1.2 | 0.31 | 93.56 | −64.03 | 76.98 |
| 6 | 1.8 | 1.8 | 1.2 | 0.53 | 89.92 | −65.95 | 67.26 |
| 7 | 1.8 | 1.8 | 1.2 | 0.66 | 82.96 | −79.00 | 64.16 |
| 8 | 1.8 | 1.8 | 1.2 | 0.78 | 82.94 | −78.96 | 62.24 |

It will be appreciated that variants of the above-disclosed and other features and functions or alternatives thereof, may be combined into many other different systems or applications. Various presently unforeseen or unanticipated alternatives, modifications, variations or improvements therein may be subsequently made by those skilled in the art, which are also intended to be encompassed by the following claims.

What is claimed is:

1. A fluorescent green toner comprising:

fluorescent agent-incorporated resin particles comprising a resin, a fluorescence brightener, and a yellow fluorescent agent having an absorption spectrum that overlaps with a fluorescence emission spectrum of the fluorescence brightener; and a cyan colorant, blue dye-incorporated resin particles comprising the resin and a blue dye, or both;

wherein the fluorescent green toner has a weight ratio of the yellow fluorescent agent to the cyan colorant and, if present, the blue dye, in a range of from 100:1 to 0.2:1, and wherein the fluorescent green toner exhibits Förster Resonance Energy Transfer (FRET) under illumination with UV light.

2. The fluorescent green toner of claim 1, wherein the fluorescent green toner is in the form of core-shell particles, each core comprising the fluorescent agent-incorporated resin particles; the cyan colorant, the blue dye-incorporated resin particles, or both; a crystalline polyester resin; and optionally, a wax; and a shell over the core.

3. The fluorescent green toner of claim 1, comprising the cyan colorant.

4. The fluorescent green toner of claim 1, wherein the weight ratio is from 10:1 to 1:1.

5. The fluorescent green toner of claim 1, wherein the fluorescence emission spectrum of the fluorescent brightener and the absorption spectrum of the yellow fluorescent agent have a degree of overlap of from 30% to 100%.

6. The fluorescent green toner of claim 1, wherein the fluorescence brightener is Fluorescent Brightener 184.

7. The fluorescent green toner of claim 1, wherein the yellow fluorescent agent is selected from Solvent Yellow 160:1, Solvent Yellow 98, Solvent Yellow 43, Basic Yellow 40, and combinations thereof.

8. The fluorescent green toner of claim 1, comprising the cyan colorant, wherein the cyan colorant is Pigment Blue 15:3.

9. The fluorescent green toner of claim 1, wherein the resin is a combination of two different types of resins, the two different types of resins having different chemical compositions.

10. The fluorescent green toner of claim 9, wherein the two different types of resins are present in the fluorescent agent-incorporated resin particles in a weight ratio of from 2:3 to 3:2.

11. The fluorescent green toner of claim 10, wherein the two different types of resins are two amorphous polyester resins.

12. The fluorescent green toner of claim 11, wherein the two amorphous polyester resins are a poly(propoxylated bisphenol-co-terephthlate-fumarate-dodecenylsuccinate) and a poly(propoxylated-ethoxylated bisphenol-co-terephthalate-dodecenylsuccinate-trimellitic anhydride).

13. The fluorescent green toner of claim 1, having a total amount of the fluorescent brightener and the yellow fluorescent agent in a range of from 0.5 weight % to 5 weight % by weight of the fluorescent green toner and a weight ratio of the fluorescent brightener to the yellow fluorescent agent in a range of from 1:10 to 1:0.5.

14. The fluorescent green toner of claim 2, wherein the crystalline polyester resin has Formula I Formula I

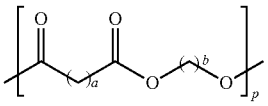

wherein each of a and b is in the range of from 1 to 12 and p is in the range of from 10 to 100.

15. The fluorescent green toner of claim 14, wherein the crystalline polyester resin is a poly(1,6-hexylene-1,12-dodecanoate).

16. The fluorescent green toner of claim 1, wherein the fluorescence brightener is Fluorescent Brightener 184; the yellow fluorescent agent is Solvent Yellow 160:1, Solvent Yellow 98, or combinations thereof; and comprising the cyan colorant as Pigment Blue 15:3.

17. The fluorescent green toner of claim 16, the fluorescent green toner in the form of core-shell particles, each core comprising the fluorescent agent-incorporated resin particles, the cyan colorant; a crystalline polyester resin; and optionally, a wax; and a shell over the core.

18. The fluorescent green toner of claim 17, wherein the resin is a combination of a poly(propoxylated bisphenol-co-terephthlate-fumarate-dodecenylsuccinate) and a poly (propoxylated-ethoxylated bisphenol-co-terephthalate-dodecenylsuccinate-trimellitic anhydride) and the crystalline polyester resin is a poly(1,6-hexylene-1,12-dodecanoate).

19. A method of making a fluorescent green toner, the method comprising:

forming one or more fluorescent latexes which comprise a fluorescence brightener, a yellow fluorescent agent having an absorption spectrum that overlaps with a fluorescence emission spectrum of the fluorescence brightener, a first type of amorphous resin, and a second type of amorphous resin;

forming a cyan dispersion comprising a cyan colorant and a surfactant;

forming a mixture comprising the one or more fluorescent latexes; the cyan dispersion;

one or more emulsions which comprise a crystalline resin, the first type of amorphous resin, the second type of amorphous resin; and optionally, a wax dispersion;

aggregating the mixture to form particles of a predetermined size;

forming a shell over the particles of the predetermined size to form core-shell particles; and coalescing the core-shell particles to form a fluorescent green toner, wherein the fluorescent green toner has a weight ratio of the yellow fluorescent agent to the cyan colorant in a range of from 100:1 to 0.2:1, and wherein the fluorescent green toner exhibits FRET under illumination with UV light.

20. A method of using the fluorescent green toner of claim 1, the method comprising:

forming an image comprising the fluorescent green toner using a xerographic printer;

transferring the image comprising the fluorescent green toner to an image receiving medium; and fusing the fluorescent green toner to the image receiving medium.

* * * * *